United States Patent [19]

Boie et al.

[11] Patent Number: 4,537,486

[45] Date of Patent: Aug. 27, 1985

[54] APPARATUS FOR THE EXPOSURE AND DEVELOPMENT OF PHOTOGRAPHIC IMAGES

[75] Inventors: Immo Boie, Niederkassel; Hermann Lührig, Leverkusen; Guido Kovacic, Unkel, all of Fed. Rep. of Germany

[73] Assignee: Agfa-Gevaert Aktiengesellschaft, Leverkusen, Fed. Rep. of Germany

[21] Appl. No.: 595,826

[22] Filed: Apr. 2, 1984

Related U.S. Application Data

[62] Division of Ser. No. 497,087, May 23, 1983.

[30] Foreign Application Priority Data

Jun. 3, 1982 [DE] Fed. Rep. of Germany ..... 3220912

[51] Int. Cl.[3] ..... G03D 9/00; G03D 3/16

[52] U.S. Cl. ..... 354/317; 354/324; 354/346; 355/27

[58] Field of Search ..... 354/317, 323, 324, 331, 354/303, 345, 346; 355/27; 430/212, 220, 236

[56] References Cited

U.S. PATENT DOCUMENTS

| | | | |
|---|---|---|---|
| 2,780,974 | 2/1957 | Fairbank | 354/317 |
| 3,081,687 | 3/1963 | Takats | 354/317 |
| 3,149,550 | 9/1964 | Lohse et al. | 354/323 |
| 3,415,645 | 12/1968 | Land | 430/220 |
| 3,620,724 | 11/1971 | Land | 430/236 |
| 3,644,036 | 2/1972 | Canfield | 355/27 |
| 4,407,929 | 10/1983 | Boie | 430/212 |

FOREIGN PATENT DOCUMENTS

| | | | |
|---|---|---|---|
| 76670 | 4/1984 | European Pat. Off. | 354/331 |

*Primary Examiner*—A. A. Mathews

*Attorney, Agent, or Firm*—Connolly and Hutz

[57] ABSTRACT

Apparatus for the exposure and development of photographic images in a photographic monosheet material having two frame members. The first frame member holds the monosheet with the photosensitive side sealed against light and moisture and the opposite side facing an opening. The second frame member is hinged on the first member. Means are provided for sealing the second member in a closed position on said first member and means are provided for applying a processing liquid to the monosheet material while the frame members are closed together.

11 Claims, 9 Drawing Figures

APPARATUS FOR THE EXPOSURE AND DEVELOPMENT OF PHOTOGRAPHIC IMAGES

CROSS REFERENCE TO RELATED APPLICATION

Figure 1:
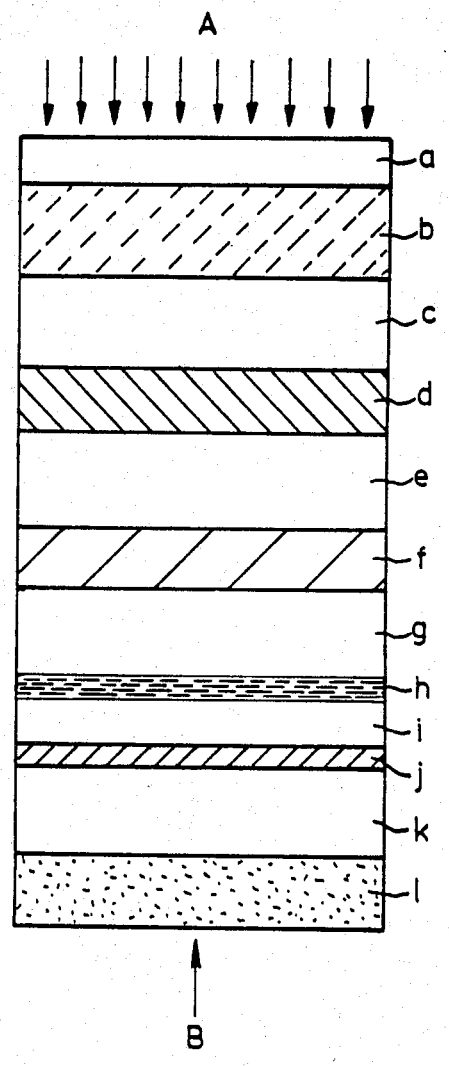

This is a division of application Ser. No. 497, 087 filed May 23, 1983 by Immo Boie et al for "A Process For The Exposure And Development Of Photographic Images And An Apparatus For Carrying Out The Process".

This invention relates to a process for the exposure and development of photographic images according to the dye diffusion process for a monosheet material, and to apparatus for carrying out the process.

In order to carry out the dye diffusion process, a photosensitive element is usually used which contains dye-producing compounds, and an image receiving element is also used, in which the desired image is produced by diffusing dyes which are transferred image-wise. For this purpose, it is necessary for there to be firm contact between the photosensitive element and the image receiving element during developing, so that the image-wise distribution of diffusing dyes which is produced in the photosensitive element as a result of development may be transferred to the image-receiving element.

The contact may be produced after developing has started, or it may have already been achieved before developing commences. The latter is the case, for example if a material is used in which the photosensitive element and the image-receiving element form an integral unit. Embodiments of the dye diffusion process are known in which an integral unit of this type still remains after the developing procedure has been completed i.e. the photosensitive element is not separated from the image-receiving element even after the dye transfer has been completed.

According to DE-A 3,045,183, an embodiment of this type comprises a transparent substrate, photosensitive elements, an opaque light-reflecting layer and an image-receiving layer which together form a rigid laminated structure into which an aqueous-alkaline solution may penetrate from the side opposite the substrate.

For the production of coloured copies, the imagewise exposure of the colour-photographic recording material is generally carried out in a darkroom, for example in contact with a transparent colour original or using a conventional projection enlarger.

A simple processing operation follows exposure and this essentially comprises bringing the exposed colour-photographic recording material into contact with an alkaline developer solution. This may be effected, for example, by immersing the material in a conventional manner into a suitable developer bath in the dark or by applying a developer preparation in paste form onto the image-receiving layer of the colour-photographic material. Instead of liquid or viscous developer preparations, simple alkaline baths or pastes may also be used if the necessary developer substances, for example phenidone or derivatives thereof, are embedded in one or more layers of the colour-photographic recording material, for example in the image-receiving layer, in the opaque light-reflecting layer or in one or more layers of the photosensitive element. Development using liquid developer baths may be carried out in trays or tanks.

The colour-photographic recording material according to DE-A 3,045,183 may be brougtt into the light after an initial dark processing time of from one to two minutes, so that the further formation of the dye transfer image may be observed in the image-receiving layer.

Thus, it is possible, within limits, to observe the formation of the dye transfer image and to stop the developing process or the subsequent diffusion of the image dyes, when desired, once a sufficient colour density has been achieved, for example by rinsing the recording material or immersing it in a mildly acid stop bath so that the pH in the colour-photographic material is lowered to such an extent that the dye anions which had been released up until then are converted into the corresponding dye acids which are no longer capable of diffusion, and a stable image is obtained.

The use of strong alkaline working solutions of a high pH for the development of the image-wise exposed image sheets in the dark according to the described process may result in considerable damage to the apparatus and may also result in injury to the processor due to the corrosive effects. Moreover, handling etching liquids in the dark is a troublesome operation.

Developing containers are known for conventional photographic materials into which the material to be developed is introduced in the dark and the container is then sealed. The different chemical solutions are successively introduced into the container in the light through inlet and outlet valves or openings and are then drawn off again after the reaction thereof. After development, the container is opened and the developed material, for example a photographic paper or a film, is removed, rinsed and dried. The construction and function of these apparatus is very complicated and they are unsuitable for the development of standard images according to the dye diffusion process.

German Gebrauchsmuster No. 8,203,539 discloses a cylindrical container for receiving the activator solution, onto which may be screwed another cylindrical container into which the image-wise exposed monosheet material is introduced. To develop the monosheet, the screw-sealed containers are overturned and after development and overturning again they may be unscrewed in the light and the monosheet may be removed for rinsing. The apparatus is extremely simple in production and handling and also provides adequate protection against contact with the alkaline activator solution.

However, this apparatus has the disadvantage that the image formation cannot be observed It is known from the above-mentioned De-A 3,045,183 that colour-photographic recording materials for the production of coloured images according to the dye diffusion transfer process may contain other layers in a particular embodiment. Thus, an additional light-absorbing layer, inter alia may be positioned between the photosensitive element and the opaque light-reflecting layer, which light-absorbing layer may consist of, for example, a binder and a dark pigment distributed therein, such as carbon black. This layer provides for the photosensitive element extra protection against light which is incident from the observation side, contributes to the improvement of definition and at the same time causes the colour image which is retained in the photosensitive element and is visible from the reverse side through the transparent substrate to appear dark and slightly more striking.

Accordingly, this additional layer is used to improve the quality and appearance of the image.

An object of the present invention is to provide a process and apparatus for carrving out the process of the initially-mentioned type, with which it is easilv possible to carrv out the image-wise exposure, as usual, in the dark and to develop the exposed monosheets in the light under visual control.

This object is achieved according to the present invention in a process of the initially-mentioned type, in that (a) a monosheet material is used, the laminated structure of which is divided by a layer which is impermeable to light but permeable to moisture into a photosensitive side of the sheet for the image-wise exposure, and a non-photosensitive side for observation and supplying the activator or developer solution, (b) the photosensitive side of the sheet is exposed image-wise in the dark, (c) the photosensitive side of the sheet is then sealed in a light-proof manner, (d) the non-photosensitive side of the monosheet lies open and is exposed to an activator in daylight to develop the latent image, so that the image formation takes place visibly, (e) once the imaqe qualitv has been achieved, development is stopped bv removing the activator and by subsequent rinsing, and (f) the monosheet is dried in a conventional manner.

By using a special and particular embodiment of a monosheet material, a process for the exposure and development of colour-photographic black and white or color images is provided in a surprising manner, in which only the image-wise exposure still has to carried out in the dark and all the other working cycles may be carried out in bright daylight.

During development in the light, the progressing image formation may be observed and stopped whenever the desired image quality has been achieved.

Chemicals are no longer handled in the dark and the dangers associated therewith are avoided. The process has another advantage in one side of the sheet does not come into contact liquids. When the photosensitive side of the sheet is sealed in a light-proof and moisture-tight manner this side does not become wet and thus doe have to be dried. Therefore, the drying time for the developed and rinsed sheet is shorter and the image sheet may be positioned with its dry side ona support and may be dried horizontally.

The activator to develop the image-wise exposed monosheet may be poured onto the non-photosensitive side which is lying open and the resulting image may be observed through the activator. However, it is also possible to immerse the image-wise exposed monosheet with the non-photosensitive side for development in an activator bath and, while so doing, to cover the photosensitive side of the monosheet so that it is light-proof and moisture-tight.

The present invention also relates to an apparatus for carrying out the process, the object being achieved in that a first substantially rectangular frame is provided in the region of one flat side with guide grooves to receive a slide which seals the frame opening, and the other flat side of the frame has a rectangular accommodating space for a monosheet, a second rectangular frame is pivotally connected by a hinge to the first frame on one side thereof and may be locked therewith on at least one other side by at least one locking device, and the second frame is provided with rubber or plastics sealing bodies on the flat side facing the first frame which are positioned such that they engage all round into the accommodating space for the monosheet, so that the monosheet may be pressed against the first frame in a light-proof and moisture-tight manner when the frames are locked together.

The exposure and development apparatus according to the present invention is surprisingly simple to produce and to handle. A monosheet material may be inserted into the accommodating space between the two frames in the dark and may be clamped by locking the two frames, and the non-photosensitive side lies open in the frame and the photosensitive side is confined in a light-proof and moisture-tight manner by the slide on the one hand and by the plastic sealing bodies on the other hand. For image-wise exposure of the monosheet, the slide is opened, the exposure is carried out by the contact process or using a conventional enlarger and the slide is then closed. The frames which are locked together may be taken into a light room with the clamped monosheet for development.

In an advantageous embodiment, the second frame is in the shape of a flat tray to receive the activator to develop the latent image. The frame is deposited with the slide part underneath on a table or into a water basin and the activator is poured into the tray. After development, the activator is returned into a stock bottle and the tray is repeatedly filled with water so that the activator is removed from the monosheet. The tray-shaped frame may be provided with a channel or a recess in one corner for pouring out the activator, thus further preventing the activator from being split.

Another embodiment of the frame is distinguished in that at least one of the frames is provided with a handle for immersing the frames into a container of activator liquid.

The container for the activator liquid is selected for this purpose such that it just accommodates the two locked frames, and the handle is not dipped into the liquid. In order to allow visual observation of the development, the container is advantageously made of a transparent material, such as glass, Plexiglas or another transparent plastics material. . After development, the apparatus is removed from the activator by the handle and is immersed in a rinsing container or is directly rinsed under running water.

After development and rinsing, the frames are unlocked and the black and white or colour image is removed and the wet side is dried in the conventional manner. After being rubbed dry, the frame may immediately be provided with another monosheet in the dark, so that one image may be produced every three to five minutes using one of these simple devices.

A modified embodiment of an apparatus for the development of photographic images to carry out the process is distinguised in that a substantially rectangular box-shaped container is provided for receiving an image-wise exposed monosheet, a hood-shaped lid made of transparent material is pivotally connected by a hinge to the container on one longitudinal side thereof and may be locked therewith on at least one other side by at least one locking device and the lid is provided with rubber or plastics sealing bodies on the side facing the container which are positioned such that they engage all round into the accommodating space for the monosheet, so that the edges of the monosheet may be pressed against the bottom of the container in a light-proof and moisture-tight manner when the container is locked with the lid, and the lid is provided with an inlet nozzle and an outlet nozzle.

This apparatus has the advantage that the monosheet may be exposed image-wise by an exposure process, for example it may be inserted into an enlargement frame of an enlarger. After exposure, the monosheet is inserted into the box-shaped container with the photosensitive side underneath and the hood-shaped lid is locked with the box-shaped container, the monosheet being pressed onto the bottom of the container in a light-proof and liquid-tight manner. The apparatus thus sealed may be brought with the monosheet into a light room. After introducing the activator through the inlet nozzle, development takes place and may be observed through the transparent lid.

After sufficient development, the activator is returned into the stock bottle through the outlet nozzle and the apparatus is connected to a water pipe or water is introduced into the apparatus. After rinsing, the hood-shaped lid is lifted up and the finished image may be removed for drying. The material only has to be dried on one side, because the photosensitive side of the sheet has not come into contact with liquids.

Another advantage of this apparatus is that there is no risk at all of contact with the activator and, neither is there the risk of clothing being soiled or the room becoming contaminated with activator, because the activator is directly introduced into the liquid-tight apparatus and is poured back into the stock bottle through the outlet nozzle. The apparatus is only opened after rinsing, so that the activator is completely removed from the apparatus.

Another advantageous apparatus is characterised in that a substantially rectangular frame is provided in the region of one flat side with guide grooves to receive a slide which seals the frame opening, and the other flat side has a rectangular accommodating space for a monosheet, a hood-shaped lid made of transparent material is pivotally connected by a hinge to the frame on one longitudinal side thereof and may be locked therewith on at least one other side by at least one locking device, and the lid is provided with rubber or plastics sealing bodies on the side facing the frame which are positioned such that they may be pressed against the accommodating space of the frame in a light-proof and moisture-tight manner all round in the accommodating space for the monosheet when the frame is locked with the lid, and the lid is provided with an inlet nozzle and an outlet nozzle.

In this embodiment, the advantages of the frame cassette having the slide, with which the photosensitive side of the monosheet is covered, are combined with the apparatus having a hood-shaped transparent lid.

Therefore, the apparatus may be used for the image-wise exposure of the clamped monosheet in the dark when the slide is open, and for the development of the monosheet in the light when the slide is closed.

Particularly safe handling of the activator liquid is achieved with an apparatus which is characterised in that the inlet nozzle is located at the highest point of the hood-shaped lid and is provided with a thread, into which a stock bottle for the activator may be screwed, and a pin is positioned in the threaded nozzle such that a valve in the stock bottle is opened shortly before the stock bottle is fully screwed into the threaded nozzle and is closed when the stock bottle is unscrewed.

The activator is in a bottle which is closed by a valve, the valve only being opened when the bottle is screwed into the threaded nozzle. After development, the apparatus is rotated by 180°, so that the lid points downwards and the activator runs back to the then lowest point and into the stock bottle which is still screwed on. After the bottle has been unscrewed, it is re-closed automatically and securely by the valve.

After the apparatus has been rotated into its original position with the lid on the top, the monosheet may be rinsed and during this operation, the apparatus may be freed from activator residues. The activator may be used repeatedly, the stock bottle being filled up from time to time with fresh activator.

The process according to the present invention may of course also be carried out using an even simpler apparatus, for example using a rectangular box-shaped container made of light-impermeable material, into which the image-wise exposed monosheet is introduced with the photosensitive side underneath. A transparent plate which is provided with an encirculating rim is positioned on the monosheet and the plate has a filling opening to receive the activator and a discharge opening for removing the activator.

However, in such a simple apparatus, there is a considerable risk of activator spillage, the possibility of peripheral exposure of the monosheet by stray light and penetration of the activator into the space between the monosheet and the bottom of the container.

The apparatus described further above allow the process for the exposure and devleopment of colour and black and white photographic images according to the dye diffusion process to be carried out simply and conveniently, but above all safely. The process and the apparatus also allow an inexperienced amateur to produce colour-photographic images from negatives or slides in a simple and inexpensive manner and to observe the formation of the images on the image-receiving layer of the monosheet, without the necessity of a darkroom for development.

Embodiments of the present invention will now be described in more detail with reference to drawings.

Figure 2:
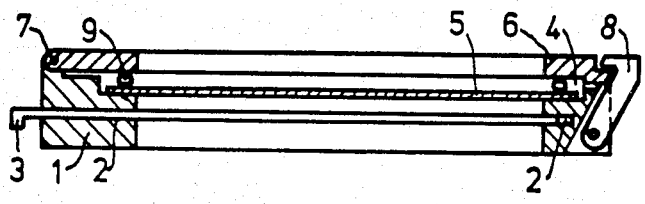
Figure 3:
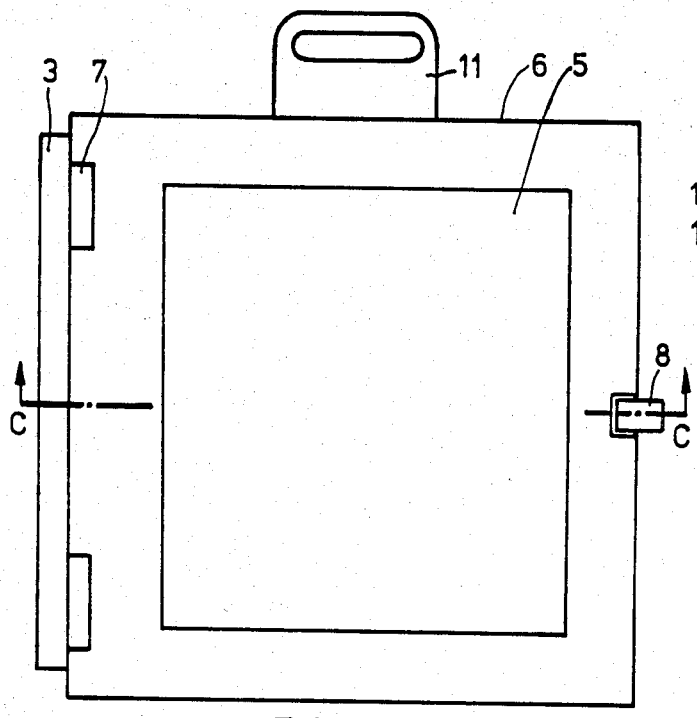
Figure 4:
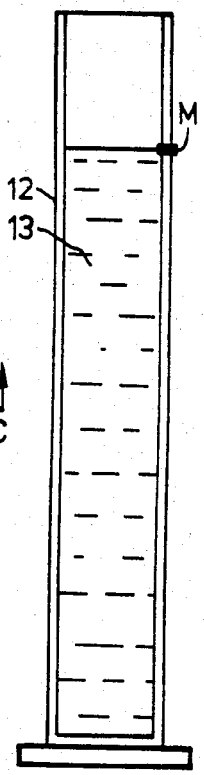
Figure 5:
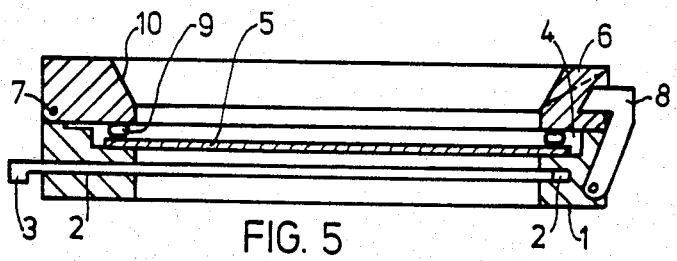
Figure 6:
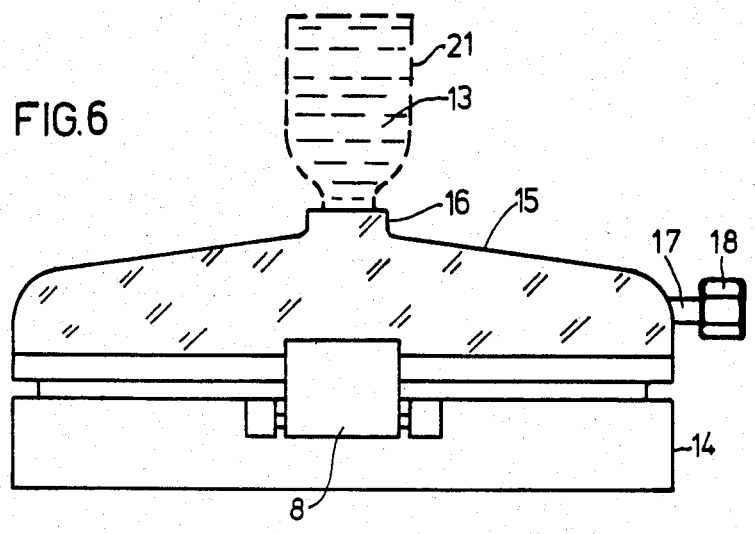
Figure 7:
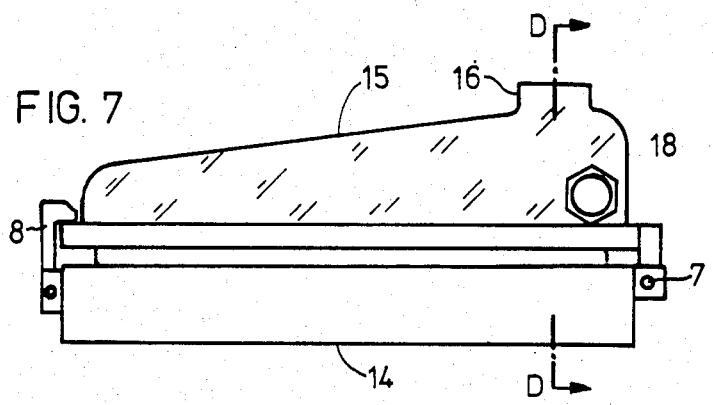
Figure 8:
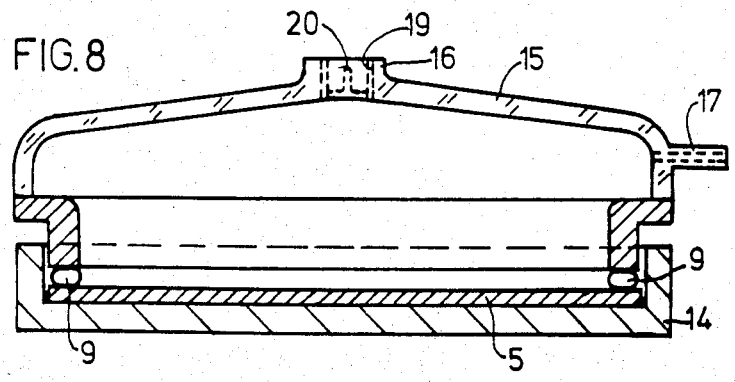
Figure 9:
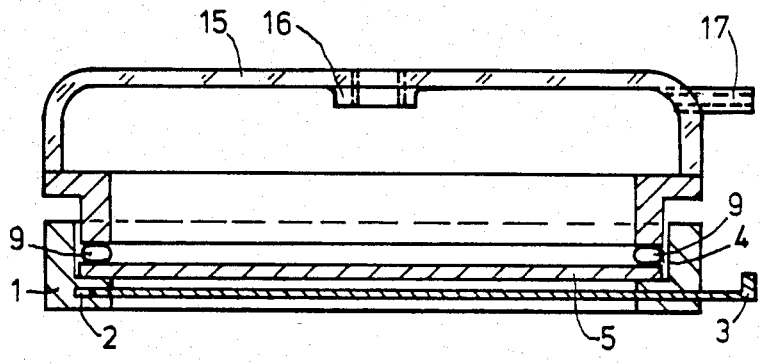

FIG. 1 illustrates an example of a layer structure of a monosheet material for the present process, FIG. 2 illustrates an apparatus for receiving a monosheet for exposure and development as a sectional image of FIG. 3 along line CC., FIG. 3 illustrates the apparatus of FIG. 2 in top view, FIG. 4 illustrates a developing tank for the monosheet in the apparatus according to FIG. 3, FIG. 5 illustrates an embodiment of the apparatus for development of the monosheet without a developing tank, FIG. 6 illustrates another advantageous embodiment of a developing apparatus for a monosheet in a front view, FIG. 7 illustrates the apparatus according to FIG. 6 in a side view, FIG. 8 illustrates a section through the apparatus according to FIG. 7 along line DD, and FIG. 9 illustrates an apparatus according to FIG. 6 with an additionally incorporated slide.

The process and the apparatus are geared to a monosheet material (i.e., one sheet containing a layer structure in which all the layers necessary for the production of a photographic image according to dye diffusion process are contained), the laminated structure of which as shown in FIG. 1 is divided by a light-impermeable layer h, for example carbon black with a binder, into a photosensitive side A for the image-wise exposure (see the arrows) and a non-photosensitive side B for the observation and the supply of the activator or developer solution (see arrow).

FIG. 1 illustrates an example of a layer structure. The following layer structure, from the exposure side A of the monosheet to the observation side B, may be selected:

(a) transparent protective layer or NC layer (antiroll layer),
(b) transparent substrate, for example polyester,
(c) blue-sensitive layer,
(d) yellow filter layer,
(e) green-sensitive layer,
(f) intermediate layer,
(g) red-sensitive layer,
(h) carbon black layer, impermeable to light but permeable to liquid,
(i) white titanium dioxide layer,
(j) gelatin layer,
(k) image-receiving layer, and
(l) protective layer.

Other layers may be embedded into, or individual layers may be omitted from this laminated structure. In the same way, it is also possible to have a layer structure which produces a black and white image and which may be exposed and developed according to the present process and by the present apparatus. The carbon black layer h is essential to the present invention, separating the sheet in light-proof manner into a photosensitive part (a) to (g) and a non-photosensitive part (i) to (l), and the image-wise exposure of A takes place in the direction of the arrows from one side of the sheet, and the development of the latent image takes place from side B of the sheet through the liquid-permeable carbon black layer. If the photosensitive side of the monosheet is covered in a light-proof manner, development may be carried out in daylight and, at the same time, the formation of the image may advantageously be observed and an assessment may be made as to whether the image has the desired colour saturation, and development may then be stopped by rinsing.

Apparatus which are advantageous to the present process have been found for carrying out the exposure in the dark and the development in the light.

The apparatus according to FIG. 2 has two frames 1, 6 for receiving a monosheet 5 in an accommodating space 4. In its lower part, the frame 1 has an encirculating groove 2, into which a slide 3 has been inserted for the light-proof and liquid-tight seal of the frame 1. The second frame 6 is pivotally attached to the first frame 1 by a hinge 7. In an advantageous embodiment, a hinge 7 is used which allows the two frames to be separated from. each other for cleaning (open hinge).

The first frame 1 has devices for firmly connecting the second frame 6 to the first frame 1, for example a hook-shaped engaging and locking device 8.

For the sealing of the frames together, a rubber or plastics sealing body 9 is introduced all round into the second frame 6 and it is pressed into the accommodating space 4 of the first frame 1 when the frames are locked. Once a monosheet 5 is introduced the frame 1, it is firmly clamped in the accommodating space 4 in a light-proof and light-tight manner.

FIG. 3 is a top view of the essentially rectangular frame 6, the slide 3, the locking device 8 and the hinges 7, the non-photosensitive side of the monosheet 5 being visible in this view. In this embodiment, one or both frames 1, 6 are provided with a handle 11 by which the frame is held when it is introduced into and removed from a developing tank 12 (FIG. 4).

The developing tank contains a developer or activator 13, for example sodium hydroxide or caustic potash solution, and is filled up to a mark M. The tank 12 is made of a transparent material, such as glass, Plexiglas or a transparent plastics material, so that the resulting colour-photographic image may be observed.

When using the apparatus for the production of a colour-photographic image, a monosheet 5, the size of which corresponds to the frame 1, is introduced into the accommodating space 4 of the frame 1 in the dark and the frames 1, 6 are locked.

The frames 1, 6 are then positioned under a conventional enlarger with the frame 6 underneath, the slide 3 is drawn out and the monosheet 5 is exposed image-wise.

After exposure, the slide 3 is inserted into the frame 1. The frames with the exposed monosheet 5 may then be brought into a light room. For development, the apparatus with the monosheet 5 is immersed into the developing tank 12 (FIG. 4) and is removed after 1 or 2 minutes if the image has the desired properties and is rinsed in another tank or under running water. After rinsing, the developed image may be removed from the frames 1, 6 and the wet side is dried.

FIG. 5 illustrates an advantageous embodiment of the apparatus according to FIG. 2, wherein the second frame 6 is designed as a tray 10. In this embodiment, a developing tank 12 is unnecessary. Instead, the activator 13 may be directly poured into the frame and after the monosheet 5 has been developed, it may be poured back into a storage container out of one corner of the frame 6. For rinsing, the frames are rinsed under water in a basin.

In order to facilitate the pouring-back operation of the activator 13, the frame 6 may be provided with an outflow channel or the like (not shown). Otherwise, operating the apparatus corresponds to the above-described method.

FIG. 6 illustrates a front view and FIG. 7 illustrates a side view of an advantageous embodiment of an apparatus to develop a monosheet material. The apparatus comprises a box-shaped lower part 14, to which a hood-shaped, transparent lid 15 is attached in a hinged and lockable manner by a hinge 7 and a locking device 8. The hood-shaped lid 15 is provided with an inlet nozzle 16 which is located at the highest point of the lid 15. The lid 15 may be provided with an outlet nozzle 17 which may be sealed by a sleeve 18.

FIG. 8 illustrates the apparatus according to FIG. 6 in a section along line DD in FIG. 7.

The box-shaped lower part of the container 14 is made of a light-impermeable material, for example plastics. The image-wise exposed monosheet 5 is introduced into the container 14 in the dark with the light-sensitive side downwards, the lid 15 is closed and locked and the apparatus is brought into a light room.

To develop the monosheet 5, jar 21 containing activator 13 is screwed onto the thread 19 of the filling nozzle 16. The jar 21 is appropriately provided with a valve for this purpose (not shown) which is opened by a pin 20 in the filling nozzle 16 shortly h=fore the jar 21 if fully screwed on and allows the activator 13 to flow into the, developing chamber.

During development, which may be observed through the lid 15 made of transparent material, the jar 21 remains on the filling nozzle 16.

During development, the discharge nozzle 17 may be closed by a sleeve 18 to prevent the activator 13 from escaping as a result of clumsy handling.

After development, the apparatus is rotated by 180°, so that the jar 21 is underneath and the activator 13 flows back into the jar 21. The arrangement of the filling nozzle 16 at the uppermost or lowest point of the lid 15 allows the activator 13 to flow back into the container 21 without substantial losses. In its overturned position, the container 21 is unscrewed and it is closed automatically by the incorporated valve.

Water is then introduced several times through the filling nozzle 16 and is poured out or is allowed to flow out through the discharge nozzle 17.

The hood-shaped lid 15 is provided on its lower side with an encirculating rubber or plastics sealing body 9 which presses the monosheet 5 firmly and tightly against the bottom of the box-shaped container 14 during the locking operation.

A further development of the apparatus according to FIGS. 6 to 8 is distinguished in that, as illustrated in FIG. 9, instead of a box-shaped container 14, a frame 1 with a slide 3 is used as the lower part of this apparatus (as in FIG. 2).

This has the advantage that the apparatus according to FIG. 9 may be simultaneously used as an exposure frame. In order to provide a level support of the apparatus during exposure, the hood-shaped lid 15 is of a flat design and the inlet nozzle 16 is sunk inwards.

In this apparatus, the activator is introduced through the inlet nozzle 16 and is poured back into the stock bottle 21 through the outlet nozzle 17 which is positioned in one corner of the lid 15.

We claim:

1. In an apparatus for development of photographic images the combination comprising, a frame means adapted to hold a laminated monosheet material having a first member defining an opening and provided with a lateral surface extending inwardly from the frame into the opening, and forming a shoulder for receiving a photosensitive side of said monosheet material, a seal means seated over the monosheet material, a second frame member hinged to one side of the first frame member and defining an opening substantially coextensive with the opening defined by said first frame member, means for lockably attaching the first and second frame members together whereby the seal means and the monosheet material are pressed against the shoulder in the first frame in a light proof and moisture tight manner when said second member is locked to said first frame member, and means associated with said first frame member and located on the side of said first frame member most adjacent to the photosensitive layer of said monosheet material and being able to protect said photosensitive layer against light.

2. An apparatus according to claim 1, characterised in that at least one of the frame members is provided with a handle for immersing the frame means, into a container of activator liquid.

3. In an apparatus for the exposure and development of photographic images according to claim 1, the first frame member is a substantially rectangular frame provided with guide grooves capable of receiving a slide which seals the first frame member opening, and the shoulder forms a flat side providing a rectangular accommodating space defined by the first frame member for the monosheet, said second frame is a hood-shaped lid made of transparent material pivotally connected by a hinge to the first frame member on one longitudinal side thereof and capable of being locked therewith on at least one other side by at least one locking device of said means for lockably attaching the first and second frame members together, and the seal means is a rubber or plastics sealing body and on the side facing the first frame member and positioned so that said seal means and monosheet engage all round into the shoulder for the monosheet, so that the edges of the monosheet may be pressed against the shoulder of the first frame member in a light-proof and moisture-tight manner when the first frame member is locked with the lid, and the lid provided with an inlet nozzle and an outlet nozzle.

4. In an apparatus according to claim 3, the inlet nozzle is positioned at the highest point of the hood-shaped lid and is provided with a thread, into which a stock bottle for the activator thread, may be screwed and a pin is positioned in the threaded nozzle, and a valve in the stock bottle may be opened shortly before the bottle is fully screwed into the threaded nozzle and may be closed when the bottle is removed.

5. An apparatus according to claim 1, wherein said seal means is introduced into said second frame member, and clamps the monosheet material when said second frame member is locked to said first frame member.

6. An apparatus according to claim 5 wherein said seal means is a rubber or plastics sealing body and on the side of the second frame member facing the first frame member and positioned so that the seal means and monosheet engage all round into the shoulder for the monosheet.

7. An apparatus according to claim 1, wherein said second frame member is adapted to bring an activator or developer into contact with the surface of the monosheet side remote from the photosensitive layer thereof.

8. An apparatus according to claim 7, characterised in that the second frame member is designed in the shape of a flat tray for receiving an activator to develop a latent image on the non-photosensitive side of the monosheet material.

9. In an apparatus for development of photographic images the combination comprising, a laminated monosheet material comprised of a layer impermeable to light and a photosensitive layer, a frame means for holding said monosheet material having a first frame member defining an opening and provided with a lateral surface extending inwardly from the frame member into the opening and forming a shoulder, said shoulder receiving the photosensitive side of said monosheet material, a seal means seated over the monosheet material, a second frame member hinged to one side of the first frame member and defining an opening substantially coextensive with the opening defined by said first frame member means for lockably attaching the first and second frame members together whereby the seal means and the monosheet material are pressed against the shoulder in the first frame member in a light proof and moisture tight manner when said second frame member is locked to said first frame member, and, means associated with said first frame member and located on the side of said first frame member most adjacent to the photosensitive layer of said nonosheet material and being able to protect said photosensitive layer against light.

10. The combination as claimed in claim 9 wherein the laminated monosheet material comprises a layer combination in the following order, a support layer a light sensitive element comprises of one or more silver halide emulsion layers, a light impermeable and liquid permeable layer, and an image-receiving layer.

11. Apparatus for the development of photographic images using dye diffusion processing, including a developing container adapted to hold a laminated monosheet and a substantially rectangular shaped lower part provided to receive an image-wise exposed monosheet and a lid hinged to one longitudinal side of said lower part and means for lockably attaching the lid to the lower part, and a rubber or plastic sealing body provided on the side of the lid facing the lower part and positioned so that the sealing body and monosheet engage all round so that the edges of the monosheet are locked, with the lid, in a light-proof and moisture-tight manner against the bottom of the lower part, and the lid is provided with an inlet nozzle and an outlet nozzle.

* * * * *